US005629279A

United States Patent [19]

Erilli et al.

[11] Patent Number: 5,629,279

[45] Date of Patent: May 13, 1997

[54] HIGH FOAMING NONIONIC SURFACTANT BASED LIQUID DETERGENT

[75] Inventors: Rita Erilli, Liege, Belgium; Stephen Repinec, Jr., Flemington; Gilbert Gomes, Somerset, both of N.J.

[73] Assignee: Colgate-Palmolive Co., Piscataway, N.J.

[21] Appl. No.: 539,972

[22] Filed: Jul. 28, 1995

Related U.S. Application Data

[63] Continuation-in-part of Ser. No. 193,929, Feb. 9, 1994.

[51] Int. Cl.[6] ..... C11D 1/74; C11D 1/94; C11D 3/30; C11D 3/32

[52] U.S. Cl. ..... 510/237; 510/424; 510/427; 510/433; 510/490; 510/501; 510/502; 510/503

[58] Field of Search ..... 510/237, 341, 510/423, 424, 427, 433, 490, 501, 502, 503

[56] References Cited

U.S. PATENT DOCUMENTS

| | | | |
|---|---|---|---|
| 4,450,091 | 5/1984 | Schmolka | 510/122 |
| 4,595,526 | 6/1986 | Lai | 510/423 |
| 5,387,373 | 2/1995 | Naik | 510/403 |
| 5,387,375 | 2/1995 | Erilli et al. | 510/424 |
| 5,389,305 | 2/1995 | Repinec et al. | 510/237 |

*Primary Examiner*—Ardith Hertzog
*Attorney, Agent, or Firm*—Richard E. Nanfeldt; James Serafino; Paul Shapiro

[57] ABSTRACT

A high foaming, nonionic surfactant based, light duty, liquid detergent with desirable cleansing properties and mildness to the human skin comprising: a water soluble nonionic surfactant as the major active ingredient, in an amount in excess of 50% by weight of the total surfactant content; a supplemental amount of a water soluble, foaming, anionic surfactant excluding the ethoxylated alkyl ether sulfates; and a lesser amount of a water soluble, foaming zwitterionic betaine surfactant, a $C_{12-14}$ alkyl monoalkanol amide, a $C_{12-14}$ alkyl dialkanol amide, and a amine oxide.

9 Claims, No Drawings

HIGH FOAMING NONIONIC SURFACTANT BASED LIQUID DETERGENT

RELATED APPLICATION

This application is a continuation in part application of U.S. Ser. No. 8/193,929 filed Feb. 9, 1994.

BACKGROUND OF THE INVENTION

The present invention relates to novel light duty liquid detergent compositions with high foaming properties, containing a nonionic surfactant as the major active ingredient supplemented with lesser amounts of a specific group of anionic surfactants and even smaller amounts of a Zwitterionic betaine surfactant and an amine oxide in an aqueous medium.

Nonionic surfactants are in general chemically inert and stable toward pH change and are therefore well suited for mixing and formulation with other materials. The superior performance of nonionic surfactants on the removal of oily soil is well recognized. Nonionic surfactants are also known to be mild to human skin. However, as a class, nonionic surfactants are known to be low or moderate foamers. Consequently, for detergents which require copious and stable foam, the application of nonionic surfactants is limited. There have been substantial interest and efforts to develop a high foaming detergent with nonionic surfactants as the major ingredient. Yet, little has been achieved.

The prior art is replete with light duty liquid detergent compositions containing nonionic surfactants in combination with anionic and/or betaine surfactants wherein the nonionic detergent is not the major active surfactant, as shown in U.S. Pat. No. 3,658,985 wherein an anionic based shampoo contains a minor amount of a fatty acid alkanolamide. U.S. Pat. No. 3,769,398 discloses a betaine-based shampoo containing minor amounts of nonionic surfactants. This patent states that the low foaming properties of nonionic detergents renders its use in shampoo compositions non-preferred. U.S. Pat. No. 4,329,335 also discloses a shampoo containing a betaine surfactant as the major ingredient and minor amounts of a nonionic surfactant and of a fatty acid mono- or di-ethanolamide. U.S. Pat. No. 4,259,204 discloses a shampoo comprising 0.8–20% by weight of an anionic phosphoric acid ester and one additional surfactant which may be either anionic, amphoteric, or nonionic. U.S. Pat. No. 4,329,334 discloses an anionic-amphoteric based shampoo containing a major amount of anionic surfactant and lesser amounts of a betaine and nonionic surfactants.

U.S. Pat. No. 3,935,129 discloses a liquid cleaning composition based on the alkali metal silicate content and containing five basic ingredients, namely, urea, glycerin, triethanolamine, an anionic detergent and a nonionic detergent. The silicate content determines the amount of anionic and/or nonionic detergent in the liquid cleaning composition. However, the foaming property of these detergent compositions is not discussed therein.

U.S. Pat. No. 4,129,515 discloses a heavy duty liquid detergent for laundering fabrics comprising a mixture of substantially equal amounts of anionic and nonionic surfactants alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient. The specific class of anionics utilized in this patent is the very same group of anionic detergents expressly excluded in present invention in order to eliminate the alkanol ethoxylate sulfation process and the potential dioxane toxicity problem. Furthermore, this patent finds heavily foaming detergents undesirable for the purpose of washing socks.

The prior art also discloses detergent compositions containing all nonionic surfactants as shown in U.S. Pat. Nos. 4,154,706 and 4,329,336 wherein the shampoo compositions contain a plurality of particular nonionic surfactants in order to effect desirable foaming and detersive properties despite the fact that nonionic surfactants are usually deficient in such properties.

U.S. Pat. No. 4,013,787 discloses a piperazine based polymer in conditioning and shampoo compositions which may contain all nonionic surfactant or all anionic surfactant.

U.S. Pat. No. 4,450,091 discloses high viscosity shampoo compositions containing a blend of an amphoteric betaine surfactant, a polyoxybutylenepolyoxyethylene nonionic detergent, an anionic surfactant, a fatty acid alkanolamide and a polyoxyalkylene glycol fatty ester. But, none of the exemplified compositions contains an active ingredient mixture wherein the nonionic detergent is present in major proportion, probably due to the low foaming properties of the polyoxybutylene polyoxyethylene nonionic detergent.

U.S. Pat. No. 4,595,526 describes a composition comprising a nonionic surfactant, a betaine surfactant, an anionic surfactant and a $C_{12}$–$C_{14}$ fatty acid monethanolamide foam stabilizer.

However, none of the above-cited patents discloses a high foaming, nonionic based, liquid detergent composition containing a nonionic surfactant as a major active ingredient and minor amounts of a supplementary high foaming anionic sulfate or sulfonate surfactant excluding ethoxylated alcohol ether sulfates, a supplementary foaming zwitterionic surfactant selected from betaine type surfactants, an amine oxide, an alkyl monoalkanol amide, an alkyl dialkanol amide and wherein the nonionic ingredient constitutes more than 50% of the total surfactant content.

SUMMARY OF THE INVENTION

It has now been found that a high foaming liquid detergent can be formulated with a nonionic surfactant as the major active ingredient which has desirable cleaning properties, mildness to the human skin and avoids the dioxane toxicity problem associated with the sulfation process of manufacturing anionic ethoxylated alcohol ether sulfates.

Accordingly, one object of the invention is to provide novel, high foaming, nonionic based, light duty liquid detergent compositions containing a nonionic ionic surfactant at a concentration of at least 50% of the total surfactant content.

Another object of this invention is to provide novel, nonionic based, liquid detergent compositions containing a major amount of nonionic surfactant supplemented with lesser amounts of an anionic surfactant, a zwitterionic betaine surfactant, an alkyl monoalkanol amide, an alkyl dialkanol amide, and an amine oxide.

Still another object of this invention is to provide a novel, nonionic based, liquid detergent with desirable high foaming and cleaning properties which is mild to the human skin.

A further object of this invention is to provide a novel, nonionic based liquid detergent containing a supplemental anionic surfactant excluding the ethoxylated alkyl ether sulfates which eliminates the alkanol ethoxylate sulfation process and the potential dioxane toxicity problem.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein the novel, high foaming, nonionic based, light duty liquid detergent of this invention comprises an alkyl monoalkanol amide and an alkyl dialkanol amide in combination with four essential surfactants a water soluble, ethoxylated, nonionic surfactant as the major active ingredient in an amount exceeding 50% by weight of the total surfactant content; a supplemental amount of a foaming anionic surfactant selected from the group consisting of water soluble organic sulfates and organic sulfonates, excluding the ethoxylated alkyl ether sulfates; a lesser amount of a foaming water soluble, zwitterionic surfactant selected from the class of betaines dissolved in an aqueous vehicle and an amine oxide, wherein the composition does not contain any polyoxyalkylene glycol fatty ester.

More specifically, the present invention relates to a high foaming, nonionic based, liquid detergent containing more than 50% by weight of the total surfactant content of a nonionic surfactant selected from the group consisting of water soluble primary aliphatic alcohol ethoxylates secondary aliphatic alcohol ethoxylates, alkyl phenol ethoxylates and alcohol ethylene oxide propylene oxide condensates; and supplementary amounts of an anionic surfactant selected from the group consisting of water soluble salts of $C_8$–$C_{18}$ alkyl sulfates, $C_8$–$C_{16}$ benzene sulfonates, $C_{10}$–$C_{20}$ paraffin sulfonates, alpha $C_{10}$–$C_{24}$ olefin sulfonates, $C_8$–$C_{18}$ alkyl sulfoacetates, $C_8$–$C_{18}$ alkyl sulfosuccinate esters, $C_8$–$C_{18}$ acyl isethionates and $C_8$–$C_{18}$ acyl taurates; an alkyl monoethanol amide; an alkyl diethanol amide; a water soluble zwitterionic betaine surfactant and an amine oxide; the total content of said amine oxide, said anionic surfactant, said alkyl monoethanol amide, said alkyl diethanol amide and said betaine surfactant, constituting less that 50% by weight of the total surfactant content, dissolved in an aqueous vehicle.

This particular combination of ingredients in the proportions, by weight, of 10 to 30% of a nonionic surfactant, 1 to 10% by weight of anionic surfactant, 0.5 to 10% by weight of a betaine surfactant, 1.0 to 5% of an amine oxide 1 to 3 wt. % of an alkyl monoalkanol amide; 1 to 3 wt. % of an alkyl dialkanol amide and the balance being water, wherein the nonionic constitutes at least 50 wt. percent of the total surfactant content is critical to the high foaming and desirable cleansing properties of present liquid detergent and the retention of the mildness to the skin property. The total amount of surfactants may constitute about 17.5%–51%, preferably about 20%–40%, most preferably 25%–35%, by weight of the liquid composition. Excluded from the instant compounds are polyoxyalkylene glycol fatty esters, abrasives, polymeric thickeners, clay thickeners, silica, abrasive, clays, alkali metal carbonates or more than 3 wt. % of a fatty acid or its salt thereof.

DETAILED DESCRIPTION OF THE INVENTION

The nonionic surfactant which constitutes the major ingredient in present liquid detergent is present in amounts of about 10%–30%, preferably 13%–25%, most preferably 16%–22%, by weight of the composition and provides superior performance in the removal of oily soil and mildness to human skin.

The water soluble nonionic surfactants utilized in this invention are commercially well known and include the primary aliphatic alcohol ethoxylates, secondary aliphatic alcohol ethoxylates, alkylphenol ethoxylates and ethylene-oxide-propylene oxide condensates on primary alkanols, such a Plurafacs (BASF) and condensates of ethylene oxide with sorbitan fatty acid esters such as the Tweens (ICI). The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water-soluble nonionic detergent. Further, the length of the polyethenoxy chain can be adjusted to achieve the desired balance between the hydrophobic and hydrophilic elements.

The nonionic detergent class includes the condensation products of a higher alcohol (e.g., an alkanol containing about 8 to 18 carbon atoms in a straight or branched chain configuration) condensed with about 5 to 30 moles of ethylene oxide, for example, lauryl or myristyl alcohol condensed with about 16 moles of ethylene oxide (EO), tridecanol condensed with about 6 to moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to about 14 carbon atoms in length and wherein the condensate contains either about 6 moles of EO per mole of total alcohol or about 9 moles of EO per mole of alcohol and tallow alcohol ethoxylates containing 6 EO to 11 EO per mole of alcohol.

A preferred group of the foregoing nonionic surfactants are the Neodol ethoxylates (Shell Co.), which are higher aliphatic, primary alcohols containing about 9–15 carbon atoms, such as $C_9$–$C_{11}$ alkanol condensed with 8 moles of ethylene oxide (Neodol 91-8), $C_{12-13}$ alkanol condensed with 6.5 moles ethylene oxide (Neoldol 23-6.5), $C_{12-15}$ alkanol condensed with 12 moles ethylene oxide (Neodol 25–12), $C_{14-15}$ alkanol condensed with 13 moles ethylene oxide (Neodol 45–13), and the like. Such ethoxamers have an HLB (hydrophobic lipophilic balance) value of about 8–15 and give good/W emulsification, whereas ethoxamers with HLB values below 8 contain less than 5 ethyleneoxy groups and tend to be poor emulsifiers and poor detergents.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$–$C_{15}$ secondary alkanol condensed with either 9 EO (Tergitol 15-S-9) or 12 EO (Tergitol 15-S-12) marketed by Union Carbide.

Other suitable nonionic detergents include the polyethylene oxide condensates of one mole of alkyl phenol containing from about 8 to 18 carbon atoms in a straight-or branched chain alkyl group with about 5 to 30 moles of ethylene oxide. Specific examples of alkyl phenol ethoxylates include nonyl condensed with about 9.5 moles of EO per mole of nonyl phenol, dinonyl phenol condensed with about 12 moles of EO per mole of phenol, dinonyl phenol condensed with about 15 moles of EO per mole of phenol and di-isoctylphenol condensed with about 15 moles of EO per mole of phenol. Commercially available nonionic surfactants of this type include Igepal CO-630 (nonyl phenol ethoxylate) marketed by GAF Corporation.

Also among the satisfactory nonionic detergents are the water-soluble condensation products of a $C_8$–$C_{20}$ alkanol with a heteric mixture of ethylene oxide and propylene oxide wherein the weight ratio of ethylene oxide to propylene oxide is from 2.5:1 to 4:1, preferably 2.8:1–3.3:1, with the total of the ethylene oxide and propylene oxide (including the terminal ethanol or propanol group) being from 60–85%, preferably 70–80%, by weight. Such detergents are commercially available from BASF-Wyandotte and a particularly preferred detergent is a $C_{10}$–$C_{16}$ alkanol condensate with ethylene oxide and propylene oxide, the weight ratio of ethylene oxide to propylene oxide being 3:1 and the total alkoxy content being about 75% by weight.

Other suitable water-soluble nonionic detergents which are less preferred are marketed under the trade name "Pluronics." The compounds are formed by condensing ethylene oxide with a hydrophobic base formed by the condensation of propylene oxide with propylene glycol. The molecular weight of the hydrophobic portion of the molecule is of the order of 950 to 4000 and preferably 200 to 2,500. The addition of polyoxyethylene radicals to the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. Preferably, these surfactants will be in liquid form and satisfactory surfactants are available as grades L 62 and L 64.

The anionic surfactant, which is an essential ingredient of present liquid detergent composition, constitutes about 1% to 10%, preferably 2%–9%, most preferably 3%–8%, by weight thereof and provides good foaming properties. However, preferably reduced amounts are utilized in order to enhance the mildness of the skin property desired in the inventive compositions, and thus, the weight ratio of nonionic detergent to anionic should exceed about 3:1. In addition, the particular group of anionic surfactants utilized excludes the $C_8$–$C_{18}$ alkyl polyethenoxy ether sulfate surfactants in order to avoid the dioxane toxicity associated with the process of sulfation of ethoxylated alcohols. Thus, the ethoxylated alcohol ether sulfates are expressly excluded from the specific group of anionic surfactants utilized.

The anionic surfactants which may be used in the nonionic based liquid detergent of this invention are water soluble such as triethanolamine and include the sodium, potassium, ammonium and ethanolammonium salts of $C_8$–$C_{18}$ alkyl sulfates such as lauryl sulfate, myristyl sulfate and the like; linear $C_8$–$C_{16}$ alkyl benzene sulfonates; $C_{10}$–$C_{20}$ paraffin sulfonates; alpha olefin sulfonates containing about 10–24 carbon atoms; $C_8$–$C_{18}$ alkyl sulfoacetates; $C_8$–$C_{18}$ alkyl sulfosuccinate esters; $C_8$–$C_{18}$ acyl isethionates; and $C_8C$-$_{18}$ acyl taurates. Preferred anionic surfactants are the water soluble $C_{12}$–$C_{16}$ alkyl sulfates, the $C_{10}$–$C_{15}$ alkylbenzene sulfonates, the $C_{13}$–$C_{17}$ paraffin sulfonates and the alpha $C_{12-C18}$ olefin sulfonates.

The water-soluble zwitterionic surfactant, which is also an essential ingredient of present liquid detergent composition, constitutes about 0.5–10%, preferably 2%–9%, most preferably 7%–8%, by weight and provides good foaming properties and mildness to the present nonionic based liquid detergent. The zwitterionic surfactant is a water soluble betaine having the general formula:

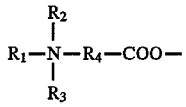

wherein $R_1$ is an alkyl group having 10 to about 20 carbon atoms, preferably 12 to 16 carbon atoms, or the amido radical:

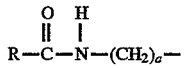

wherein R is an alkyl group having about 9 to 19 carbon atoms and a is the integer 1 to 4; $R_2$ and $R_3$ are each alkyl groups having 1 to 3 carbons and preferably 1 carbon; $R_4$ is an alkylene or hydroxyalkylene group having from 1 to 4 carbon atoms and, optionally, one hydroxyl group. Typical alkyldimethyl betaines include decyl dimethyl betaine or 2-(N-decyl-N, N-dimethyl-ammonia) acetate, coco dimethyl betaine or 2-(N-coco N, N-dimethylammonio) acetate, myristyl dimethyl betaine, palmityl dimethyl betaine, lauryl diemthyl betaine, cetyl dimethyl betaine, stearyl dimethyl betaine, etc. The amidobetaines similarly include cocoamidoethyibetaine, cocoamidopropyl betaine and the like. A preferred betaine is coco ($C_8$–$C_{18}$) amidopropyl dimethyl betaine.

Amine oxide semi-polar nonionic surfactants comprise compounds and mixtures of compounds having the formula

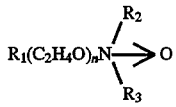

wherein $R_1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms, $R_2$ and $R_3$ are each methyl, ethyl, propyl, isopropyl, 2-hydroxyethyl, 2-hydroxypropyl, or 3-hydroxypropyl, and n is from 0 to about 10. Particularly preferred are amine oxides of the formula:

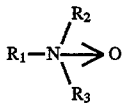

wherein $R_1$ is a $C_{12-16}$ alkyl and $R_2$ and $R_3$ are methyl or ethyl. The above ethylene oxide condensates, amides, and amine oxides are more fully described in U.S. Pat. No. 4,316,824 which is hereby incorporated herein by reference.

The concentration of the amine oxide in the instant compositions is about 1.0 to about 5 wt. %, more preferably about 2 to about 4 wt. % and most preferably about 2.5 to 3.5 wt. %.

The instant composition contains a mixture of a $C_{12-14}$ alkyl monoalkanol amide such as lauryl monoalkanol amide and a $C_{12-14}$ alkyl dialkanol amide such as lauryl diethanol amide or coco diethanol amide, wherein the concentration of the monoalkanol amide is about 1 to about 3 wt. % and the concentration of the dialkanol amide is about 1 to 3 wt. %.

All of the aforesaid ingredients in this light duty liquid detergent are water soluble or water dispersible and remain so during storage.

This particular combination of $C_{12-14}$ alkyl monoalkanol amide, $C_{12-14}$ alkyl dialkanol amide, anionic surfactant, amine oxide and betaine surfactant, provides a detergent system which coacts with the nonionic surfactant to product a liquid detergent composition with desirable foaming, foam stability, detersive properties and mildness to human skin. Surprisingly, the resultant homogeneous liquid detergent exhibits the same or better foam performance, both as to initial foam volume and stability of foam in the presence of soils, and cleaning efficacy as an anionic based light duty liquid detergent (LDLD) as shown in the following Examples.

The nonionic surfactant, the anionic surfactant, the betaine surfactant, the $C_{12-14}$ alkyl monoalkanol amide, the $C_{12-14}$ alkyl dialkanol amide and the amine oxide are solubilized in the water. To the composition can also be added water soluble hydrotropic salts include sodium, potassium, ammonium and mono-, di- and triethanolammonium salts. While the aqueous medium is primarily water, preferably said solubilizing agents are included in order to control the viscosity of the liquid composition and to control low temperature cloud clear properties. Usually, it is desirable to maintain clarity to a temperature in the range of 5° C. to 100° C. Therefore, the proportion of solubilizer generally will be from about 1%–15%, preferably 2%–12%, most preferably 2%–8%, by weight of the detergent composition with the proportion of ethanol, when present, being 5% of weight or less in order to provide a composition having a flash point above about 46° C. Preferably the solubilizing ingredient will be a mixture of ethanol and either sodium xylene sulfonate or sodium cumene sulfonate or a mixture of said sulfonates or ethanol and urea. Inorganic salts such as sodium sulfate, magnesium sulfate, sodium chloride and sodium citrate can be added at concentrations of 0.5 to 4.0 wt. % to modify the cloud point of the nonionic surfactant and thereby control the haze of the resultant solution. Various other ingredients such as urea at a concentration of about 0.5 to 4.0 wt. % or urea at the same concentration in combination with ethanol at a concentration of about 0.5 to 4.0 wt. % can be used as solubilizing agents. Other ingredients which have been added to the compositions at concentrations of about 0.1 to 4.0 wt. percent are perfumes, sodium bisulfite, ETDA, isoethanoeic acid and proteins such as lexine protein. The foregoing solubilizing ingredients also facilitate the manufacture of the inventive compositions because they tend to inhibit gel formation.

In addition to the previously mentioned essential and optional constituents of the light duty liquid detergent, one may also employ normal and conventional adjuvants, provided they do not adversely affect the properties of the detergent. Thus, there may be used various coloring agents and perfumes; ultraviolet light absorbers such as the Uvinuls, which are products of GAF Corporation; sequestering agents such as ethylene diamine tetraacetates; magnesium sulfate heptahydrate; pearlescing agents and opacifiers; pH modifiers; etc. The proportion of such adjuvant materials, in total will normally not exceed 15% of weight of the detergent composition, and the percentages of most of such individual components will be a maximum of 5% by weight and preferably less than about 2% by weight. Sodium formate can be included in the formula as a perservative at a concentration of 0.1 to 4.0%. Sodium bisulfite can be used as a color stabilizer at a concentration of about 0.01 to 0.2 wt. %

The present nonionic based light duty liquid detergents such as dishwashing liquids are readily made by simple mixing methods from readily available components which, on storage, do not adversely affect the entire composition. However, it is preferred that the nonionic surfactant be mixed with the solubilizing ingredients, e.g., ethanol and, if present, prior to the addition of the water to prevent possible gelation. The nonionic based surfactant system is prepared by sequentially adding with agitation the anionic surfactant, the betaine surfactant, the amine oxide, the $C_{12-14}$ alkyl monoalkanol amide and the $C_{12-14}$ alkyl dialkanol amide to the aqueous solution of the non-ionic surfactant which has been previously mixed with a solubilizing agent such as ethyl alcohol and/or sodium xylene sulfonate to assist in solubilizing said surfactants, and then adding with agitation the formula amount of water to form an aqueous solution of the nonionic based surfactant system. The use of mild heating (up to 100° C.) assists in the solubilization of the surfactants. The viscosities are adjustable by changing the total percentage of active ingredients. Usually, no thickening agent is added, but thickeners may be added if higher viscosity liquids are desired. In all such cases the product made will be pourable from a relatively narrow mouth bottle (1.5 cm. diameter) or opening, and the viscosity of the detergent formulation will not be so low as to be like water. The viscosity of the detergent desirably will be at least 100 centipoises (cps) at room temperature, but may be up to about 1,000 centipoises as measured with a Brookfield Viscometer using a number 3 spindle rotating at 12 rpm. Its viscosity may approximate those of commercially acceptable detergents now on the market. The detergent viscosity and the detergent itself remain stable on storage for lengthy periods of time, without color changes or settling out of any insoluble materials. The pH of this formation is substantially neutral to skin, e.g., about 4.5 to 8 and preferably about 5.0 to about 5.0.

These products have unexpectedly desirably properties. For example, the foam quality and detersive property is equal to or better than standard light duty liquid detergents while using a nonionic surfactant as the primary surfactant and minimal amounts of anionic surfactant, thereby achieving a mild, non-irritating liquid detergent.

The following examples are merely illustrative of the invention and are not to be construed as limiting thereof.

DESCRIPTION OF THE PREFERRED EMBODIMENTS

EXAMPLE 1

The following formulas were prepared at room temperature by simple liquid mixing procedures as previously described

| | A | B | C | D |
|---|---|---|---|---|
| Nonionic Neodol 11-9 | 19 | 19 | 19 | 19 |
| Ammonium Lauryl sulfate | 6 | 6 | 8 | — |
| Sodium lauryl sulfate | — | — | — | 9.5 |
| Paraffin Na sulfonate | — | — | — | — |
| Cocoamido propyl betaine | 2.5 | 2.5 | 2.5 | 2.5 |
| Dioctyl sulfo-succinate | — | — | — | — |
| LMMEA | 2.0 | 4.0 | — | — |
| LDEA | 2.0 | — | — | — |
| Amine Oxide | 2.5 | 2.5 | 4.5 | 3.0 |
| Water | Balance | Balance | Balance | Balance |
| Product Appearance | Okay | need solubilizer | need solubilizer | need solubilizer |
| Foam Volume Test Start (ml) | 50 | — | 10 | — |
| Foam Volume Test end (ml) | 100 | — | 50 | — |
| Miniplate Test (1) (number of miniplates) | — | 48 | — | — |

(1) I. R. M. Anstell et al, The Journal of the American Oil Chemist Society, Vol 43, page 576–580 (1966)

| | E | F | G | H | I Skin Sensitive Palmolive |
|---|---|---|---|---|---|
| Nonionic Neodol 11-9 | 19 | 19 | 19 | 20.5 | |
| Ammonium lauryl sulfate | 9.5 | — | — | — | |
| Sodium lauryl sulfate | 9.5 | — | — | — | |
| Paraffin Na sulfonate | — | 6.0 | 7.1 | 8.0 | |
| Cocoamido propylbetaine | 2.5 | 2.5 | 2.5 | 2.5 | |
| Dioctyl sulfo-succinate | — | — | — | — | |
| LMMEA | — | 2.0 | — | — | |
| LDEA | — | 2.0 | — | — | |
| Amine Oxide | 3.0 | 2.5 | 3.0 | 3.0 | |
| Water | Bal | Bal | Bal | Bal | |
| Product Appearance | need solubilizer | Okay | need solubilizer | need solubilizer | Okay |
| Foam Volume Test Start (ml) | 50 | — | — | 50 | 5 |
| Foam Volume Test end (ml) | 150 | — | — | 100 | 100 |
| Miniplate Test (number of miniplates) | N/A | 29 | 27 | — | — |

EXAMPLE 2

Formula I of Example 1 (composition of U.S. Pat. No. 4,595,526) and Formula A of Example I were compared in a Hand Dish Wash Test. The test was run with Olive Oil, Beef Tallow and Butter in a ratio of equal amounts. The results show that Formula A of Example I gave better results than the standard Formula I (U.S. Pat. No. 4,595,526). The test was run blind with each trial consisting of two runs of each product and the test was done in hard water (300 ppm).

Results of Formula A Versus Formula L

| Trial | Sample | # Plates (300 ppm) |
|---|---|---|
| 1 | A | 8 |
| | I | 6 |
| 2 | A | 8 |
| | I | 6 |
| Average | A | 8 |
| | I | 6 |

What is claimed is:

1. A high foaming, nonionic surfactant based, light duty, liquid detergent comprising approximately, by weight, (a) 10% to 30% of a water soluble nonionic surfactant selected from the group consisting of primary and secondary $C_8$–$C_{18}$ alkanol condensates with about 5 to 30 moles of ethylene oxide, condensates of $C_8$–$C_{18}$ alkylphenol with about 5 to 30 moles of ethylene oxide, condensates of $C_8$–$C_{20}$ alkanol with a heteric mixture of ethylene oxide and propylene oxide having a weight ratio of ethylene oxide to propylene oxide from 2.5:1 to 4:1 and a total alkylene oxide content of 60% to 85% by weight and condensates of 2 to 30 moles of ethylene oxide with sorbitan mono and tri- $C_{10}$–$C_{20}$ alkanoic acid esters having an HLB of 8 to 15;

(b) 1% to 10% of a water-soluble anionic detergent selected from the group consisting of $C_8$–$C_{18}$ alkyl sulfates, $C_8$–$C_{16}$ alkylbenzene sulfonates, $C_{10}$–$C_{20}$ paraffin sulfonates, $C_{10}$–$C_{24}$ alpha olefin sulfonates, $C_8$–$C_{18}$ alkyl sulfosuccinate esters, $C_8$–$C_{18}$ acyl isethionates and $C_8$–$C_{18}$ acyl taurates; and (c) 0.5% to 10% of a water-soluble betaine;

(d) 1 to 3 wt. % of a $C_{12-14}$ alkyl monoalkanol amide;

(e) 1 to 3 wt. % of a $C_{12-14}$ alkyl dialkanol amide;

(f) 1% to 5% of a water soluble amine oxide; and (g) the balance being water as an aqueous medium in which said nonionic surfactant, said anionic detergent, said betaine, said $C_{12-14}$ alkyl monoalkanol amide, said $C_{12-14}$ alkyl dialkanol amide and said amine oxide are solubilized in said water, wherein the sum of B, C, D, E and F being from 15% to 48% by weight of the composition of the total surfactant content, said nonionic surfactant being in excess of 50% by weight of the total surfactant content, said composition does not contain any ethoxylated alkyl ether sulfate and said composition does not contain any polyoxyalkylene glycol fatty ester.

2. A liquid detergent composition according to claim 1 which includes, in addition, 1% to 15% by weight of a solubilizing agent which is selected from the group consisting of water soluble salts of $C_1$–$C_3$ substituted benzene sulfonate hydrotropes and mixtures thereof.

3. A liquid detergent composition according to claim 2 wherein said nonionic surfactant is a condensate of a primary $C_8$–$C_{18}$ alkanol with about 5–30 moles of ethylene oxide.

4. A liquid detergent composition according to claim 3 wherein said anionic detergent is selected from the group consisting of $C_{12}$–$C_{16}$ alkyl sulfates, $C_{10}$–$C_{15}$ alkylbenzene sulfonates, $C_{13}$–$C_{17}$ paraffin sulfonates and $C_{12}$–$C_{18}$ alpha olefin sulfonates.

5. A liquid detergent composition according to claim 1 wherein said nonionic surfactant is present in an amount of 16% to 22% by weight, said anionic detergent is present in an amount of 2% to 9% by weight and said betaine is present in an amount of 2% to 9% by weight.

6. A liquid detergent composition according to claim 5 wherein said anionic detergent is a $C_{12}$–$C_{16}$ alkyl sulfate.

7. A liquid detergent composition according to claim 1 further including a preservative.

8. A liquid detergent composition according to claim 1 further including a color stabilizer.

9. A liquid detergent composition according to claim 1, wherein $C_{12-14}$ alkyl monoalkanol amide is a $C_{12-14}$ alkyl monoethanol amide and said $C_{12-14}$ alkyl dialkanol amide is a $C_{12-14}$ alkyl diethanol amide.

* * * * *